US010527057B2

(12) United States Patent
Wei et al.

(10) Patent No.: US 10,527,057 B2
(45) Date of Patent: Jan. 7, 2020

(54) FAN MODULE

(71) Applicant: Delta Electronics, Inc., Taoyuan (TW)

(72) Inventors: Wei-Che Wei, Taoyuan (TW); Hsiu-Wei Wu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 203 days.

(21) Appl. No.: 15/702,196

(22) Filed: Sep. 12, 2017

(65) Prior Publication Data

US 2019/0078585 A1 Mar. 14, 2019

(51) Int. Cl.
*F04D 29/38* (2006.01)
*F04D 29/16* (2006.01)
*F04D 29/32* (2006.01)

(52) U.S. Cl.
CPC ..... *F04D 29/384* (2013.01); *F04D 29/164* (2013.01); *F04D 29/325* (2013.01)

(58) Field of Classification Search
CPC ..... F04D 29/388; F04D 29/164; F05D 2240/305; F05D 2240/307
See application file for complete search history.

(56) References Cited

U.S. PATENT DOCUMENTS 1,041,913 A * 10/1912 Tyson ..... F04D 29/384 416/236 R
4,757,587 A * 7/1988 Choi ..... F04D 29/384 29/889.3
5,525,269 A * 6/1996 Connolly ..... B01F 3/04609 261/93
6,352,408 B1 * 3/2002 Kilian ..... B63H 1/14 416/191
6,994,523 B2 * 2/2006 Eguchi ..... F04D 29/384 416/228
7,438,522 B2 10/2008 Eimer

FOREIGN PATENT DOCUMENTS

TW 162797 7/1991

* cited by examiner

*Primary Examiner* — Ninh H. Nguyen
(74) *Attorney, Agent, or Firm* — Muncy, Geissler, Olds & Lowe, P.C.

(57) ABSTRACT

A fan module is provided, including a hub, a plurality of blades connected to the hub, and a plurality of longitudinal members. Each of the blades includes a base side connected to the hub, an end side opposite to the base side, a windward side, a leeward side opposite to the windward side, a windward surface, and a leeward surface opposite to the windward surface. The windward and leeward sides are connected to the base side and the end side. Each of the longitudinal members is disposed on the leeward surface of each of the blades, connected to the end side, and has a first end, a second end, and a tapered structure. The first and second ends face the leeward and windward sides respectively. The height of the first end is the maximum height of the longitudinal member. The tapered structure is connected to the second end.

20 Claims, 11 Drawing Sheets

FAN MODULE

BACKGROUND OF THE INVENTION

Field of the Invention

The application relates in general to a fan module, and in particular, to a fan module having a plurality of longitudinal members.

Description of the Related Art

When a conventional fan module operates, a blade impels the air and the air flows past a surface of the blade. However, when the air flows from the high-pressure surface to the low-pressure surface and rotates, a tip vortex is easily generated, and the fan is noisy during operation.

For reducing the noise produced by the tip vortex, U.S. Pat. No. 7,438,522 provides a fan having a flow element equipped in the region of outer edge of the blade, so as to reduce the leakage of the air. Similarly, in patent TW 162797, a curved protrusion is formed on the bottom of the blade to reduce the turbulent flow and the noise.

However, when the fan module rotates at a high rotational speed, the ability to reducing noise using the aforementioned method is limited. Therefore, how to solve the aforementioned questions has become an important issue.

BRIEF SUMMARY OF INVENTION

To address the deficiencies of conventional products, an embodiment of the invention provides a fan module, including a hub, a plurality of blades connected to the hub, and a plurality of longitudinal members. Each of the blades includes a base side connected to the hub, an end side opposite to the base side, a windward side, a leeward side opposite to the windward side, a windward surface, and a leeward surface opposite to the windward surface. The windward and leeward sides are connected to the base side and the end side. Each of the longitudinal members is disposed on the leeward surface of each of the blades, connected to the end side, and has a first end, a second end, and a tapered structure. The first end faces the leeward side and the second end faces the windward side. The height of the first end is the maximum height of the longitudinal member. The tapered structure is connected to the second end.

An embodiment of the invention further provides a fan module, including a hub, a plurality of blades connected to the hub, and a plurality of longitudinal members. Each of the blades includes a base side connected to the hub, an end side opposite to the base side, a windward side, a leeward side opposite to the windward side, a windward surface, and a leeward surface opposite to the windward surface. The windward and leeward sides are connected to the base side and the end side. Each of the longitudinal members is disposed on the leeward surface of each of the blades, connected to the end side, and has a first end and a second end. The first end faces the leeward side and the second end faces the windward side. The height of the first end is the maximum height of the longitudinal member.

In some embodiments, each of the longitudinal members is extended from the windward side to the leeward side.

In some embodiments, each of the longitudinal members has an outer wall aligned with the end side.

In some embodiments, each of the longitudinal members has a bottom surface, and the windward surface is parallel to the bottom surface between the first end and a predetermined position of the longitudinal member.

In some embodiments, the distance between the first end and the predetermined position of the longitudinal member is ½-¼ of the length of the longitudinal member.

In some embodiments, the longitudinal members have a substantially uniform thickness in the radial direction of the fan module.

In some embodiments, the hub has a central axis, and each of the longitudinal members has an inner wall, wherein the center of curvature of the inner wall is disposed on the central axis.

In some embodiments, each of the longitudinal members has a bottom surface and an outer wall, and the bottom surface is inclined relative to the outer wall.

In some embodiments, each of the longitudinal members has a bottom surface and an outer wall, and the bottom surface is perpendicular to the outer wall.

In some embodiments, the windward side has a plane structure, a concave structure, or a convex structure.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The embodiments of the fan module are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood to one of ordinary skill in the art to which this invention belongs. It should be appreciated that each term, which is defined in a commonly used dictionary, should be interpreted as having a meaning conforming to the relative skills and the background or the context of the present disclosure, and should not be interpreted by an idealized or overly formal manner unless defined otherwise.

Figure 1:
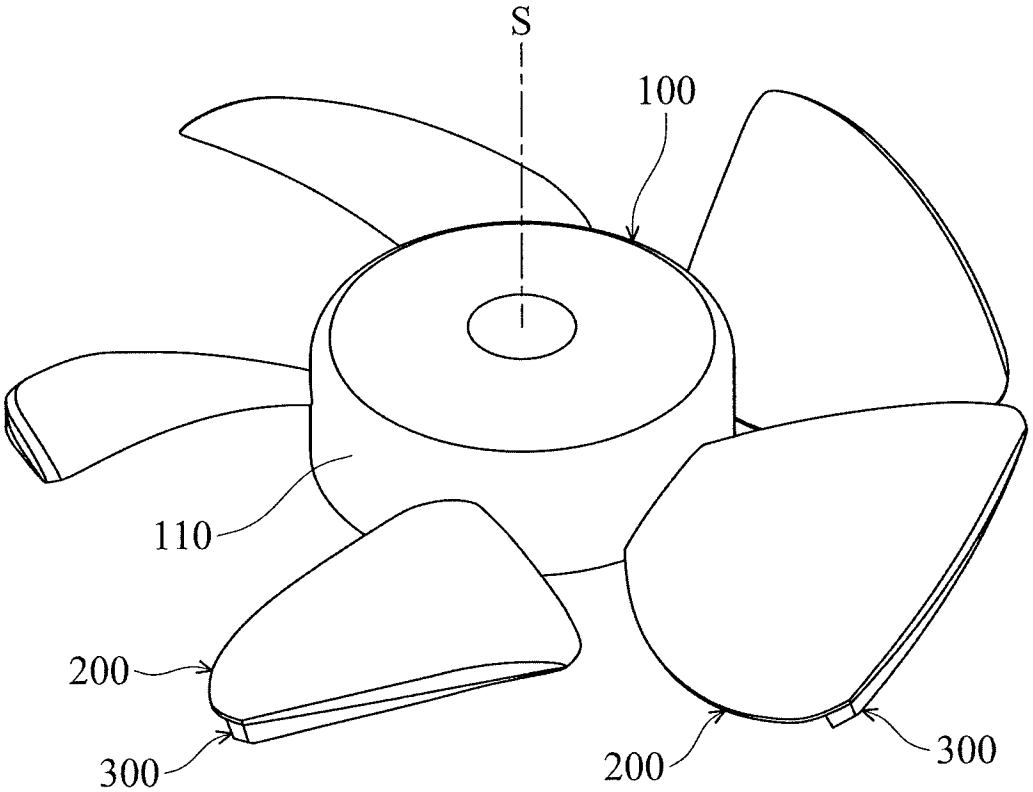
FIG. 1 is a schematic diagram of a fan module according to an embodiment of the invention.

Referring to FIG. 1, a fan module in an embodiment of the invention primarily comprises a hub 100, a plurality of blades 200, and a plurality of longitudinal members 300. The hub 100 can be a disk-shaped hollow structure having a hub lateral surface 110, and the motor (not shown) can be disposed in the hub 100. The hub 100 can be driven by the motor and rotate around a central axis S.

Figure 2:
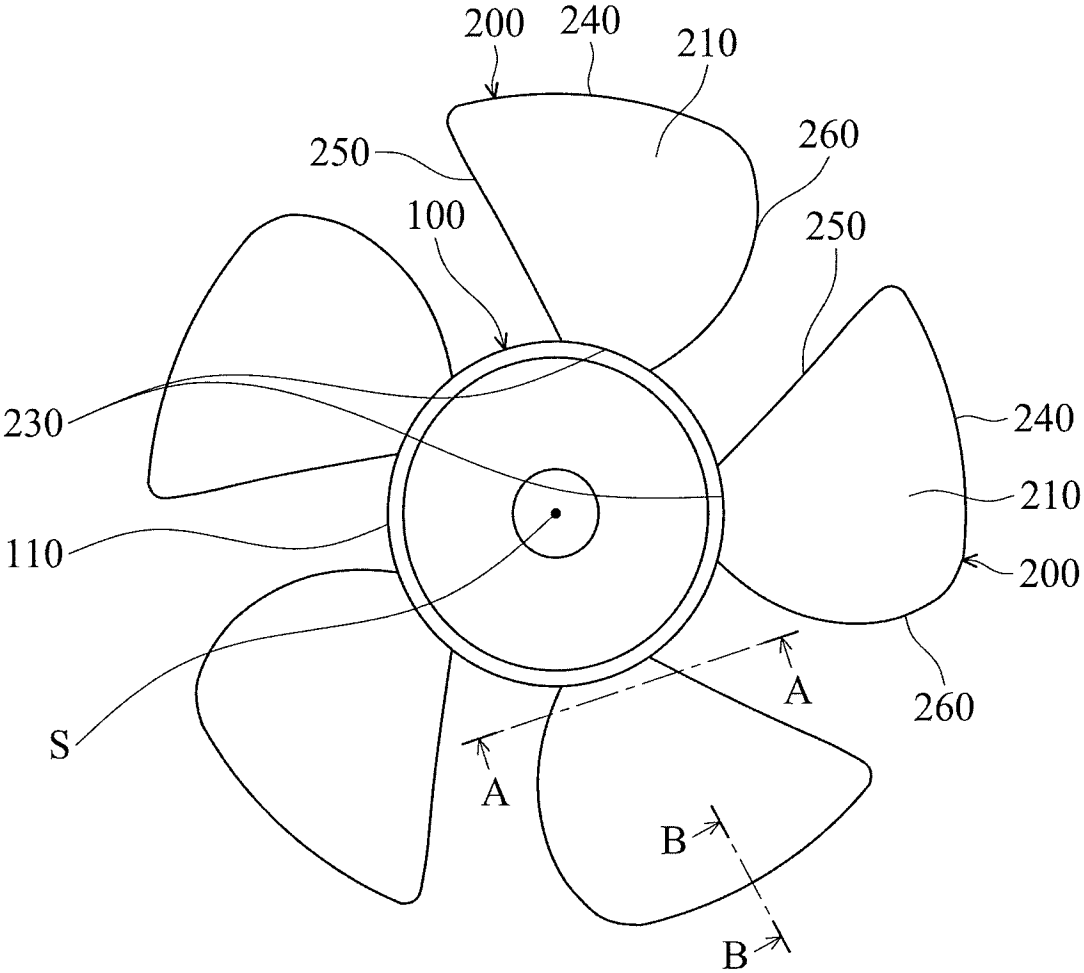
FIG. 2 is a top view of the fan module according to an embodiment of the invention.
Figure 3:
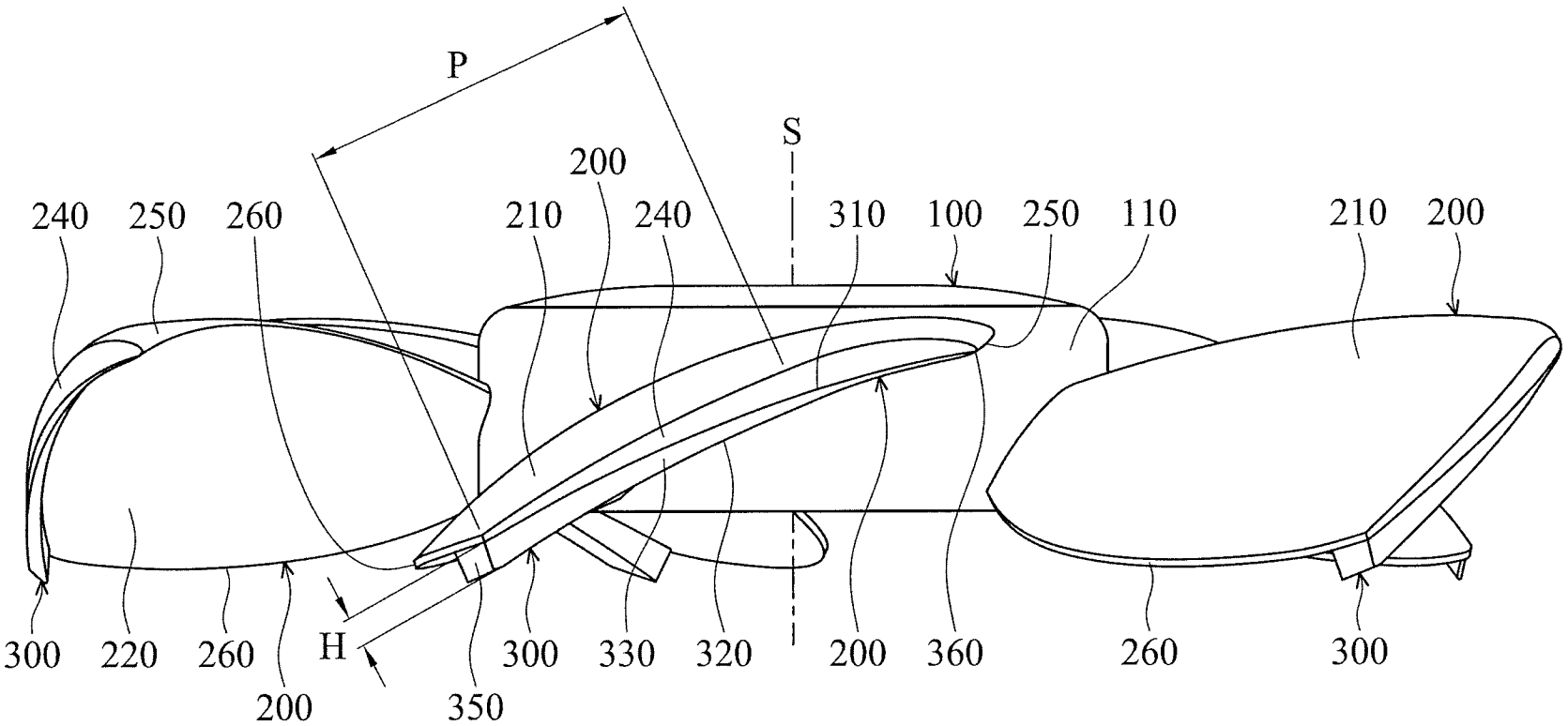
FIG. 3 is a side view of the fan module according to an embodiment of the invention.
Figure 4:
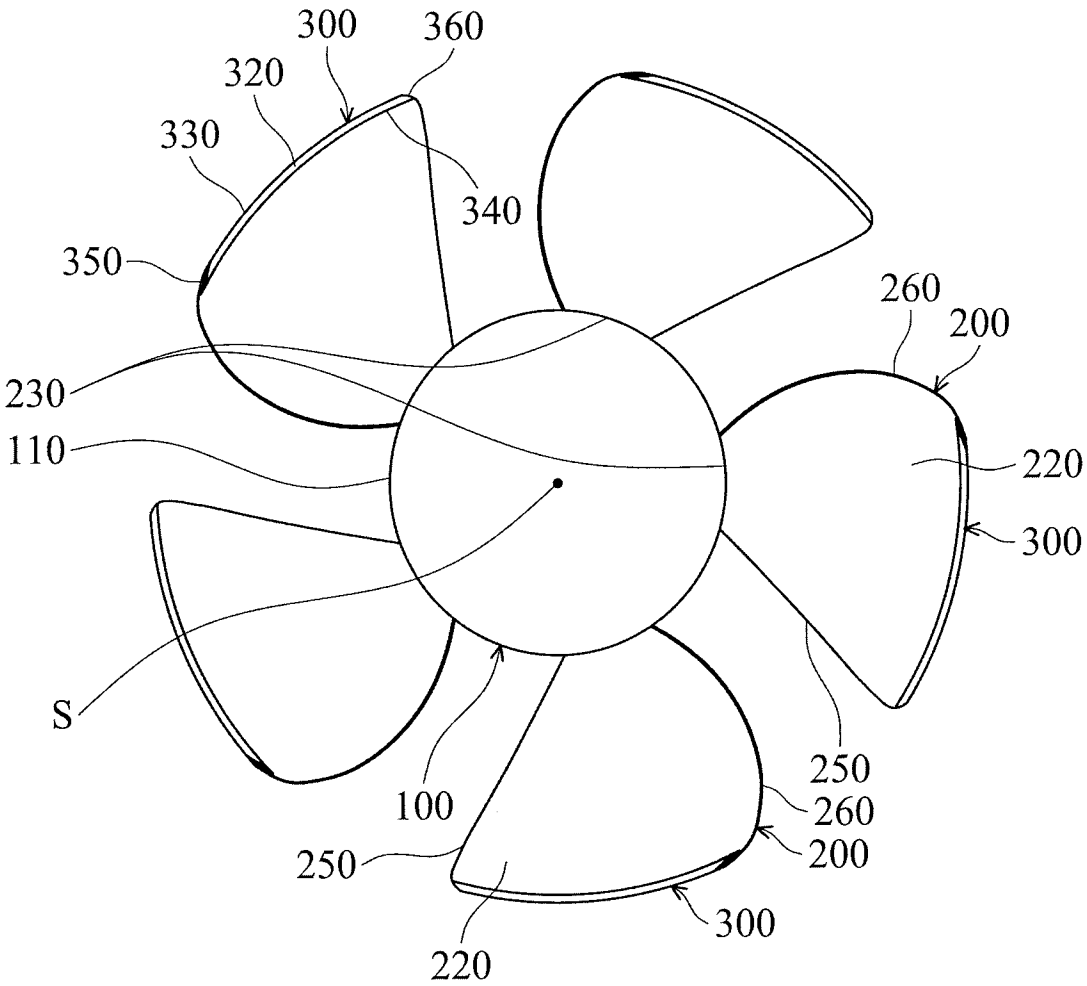
FIG. 4 is a bottom view of the fan module according to an embodiment of the invention.

FIG. 2 is a top view of the fan module shown in FIG. 1, FIG. 3 is a side view of the aforementioned fan module, and FIG. 4 is a bottom view of the aforementioned fan module. Referring to FIGS. 2-4, the blades 200 have a sheet-shaped structure, connect to the hub 100 and separate from each other, and radially extend from the hub lateral surface 110.

Each of the blades 200 comprises a windward surface 210, a leeward surface 220, a base side 230, an end side 240, a windward side 250, and a leeward side 260, wherein the windward surface 210 and the leeward surface 220 are disposed on the opposite sides of the blade 200, and occupies the most of the area of the blade 200. The windward surface 210 is the surface corresponding to the airflow enters the fan module, and the leeward surface 220 is the surface corresponding to the airflow leaves the fan module.

The base side 230, the end side 240, the windward side 250, and the leeward side 260 surround the windward surface 210 and the leeward surface 220. The base side 230 is connected to the hub lateral surface 110, and the base side 230 and the end side 240 are disposed on the opposite sides of the blade 200. Each of the windward side 250 and the leeward side 260 is connected to the base side 230 and the end side 240, and the windward side 250 and the leeward side 260 are disposed on the opposite sides of the blade 200. The windward side 250 of the blade 200 faces the leeward side 260 of the adjacent blade 200. When the hub 100 drives the blade 200 rotates relative to the central axis S, the air flows from the windward side 250 to the leeward side 260.

Figure 5:
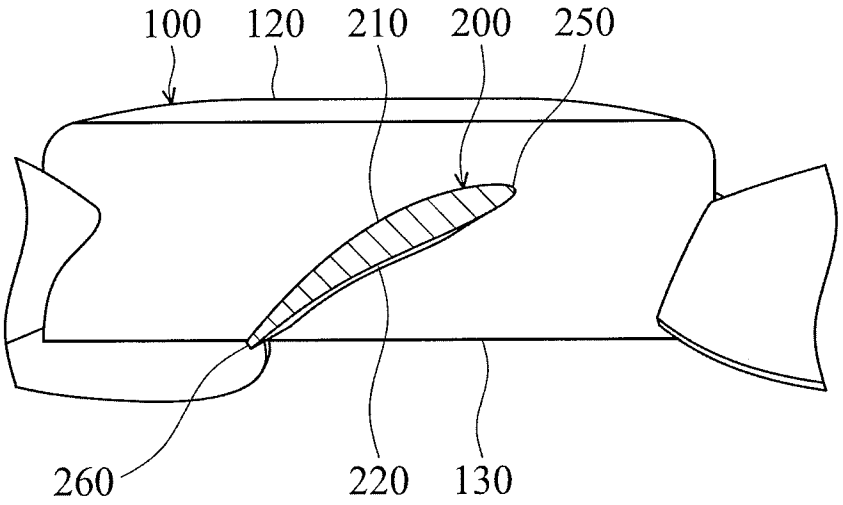
FIG. 5 is a s cross-sectional view along line A-A in FIG. 2.

FIG. 5 is a cross-sectional view along line A-A in FIG. 2. As shown in FIG. 5, the windward side 250 of the blade 200 is adjacent to the upper surface 120 of the hub 100, and the leeward side 260 of the blade 200 is adjacent to the lower surface 130 of the hub 100. Thus, the blade 200 is inclined relative to the hub 100. Furthermore, the blade 200 has a streamlined cross section, so that a good flow-guiding effect can be achieved.

As shown in FIGS. 3 and 4, each of the blades 200 has one longitudinal member 300 disposed thereon. In particular, the longitudinal member 300 is disposed on the leeward surface 220 of the blade 200 and connected to the end side 240 thereof. When the hub 100 drives the blade 200 to rotate around the central axis S, the air flowing along the leeward surface 220 to the end side 240 can be blocked by the longitudinal member 300. Since less of the air leaves from the end side 240, the probability of a tip vortex being generated is reduced. Therefore, the loudness produced from the operation of the fan module can be reduced, and the purpose of noise reduction can be achieved.

It should be noted that, the aforementioned longitudinal member 300 has a top surface 310, a bottom surface 320, an outer wall 330, an inner wall 340, a first end 350, and a second end 360. The top surface 310 is attached on the leeward surface 220 of the blade 200, and the bottom surface 320 is opposite to the top surface 310. Each of the outer wall 330 and the inner wall 340 is connected to the top surface 310 and the bottom surface 320, and disposed on the opposite surfaces of the longitudinal member 300. In this embodiment, the outer wall 330 of the longitudinal member 300 is aligned with the end side 240 of the blade 200 so that the blade 200 can achieve an integrated appearance. The distances between the central axis S and every section of the inner wall 340 are the same: in other words, the center of curvature of the inner wall 340 is disposed on the central axis S.

The first end 350 of the longitudinal member 300 is connected to the leeward side 260 of the blade 200, and the second end 360 opposite to the first end 350 is connected to the windward side 250 of the blade 200. Since the longitudinal member 300 in the embodiment is extended from the windward side 250 to the leeward side 260 and has a substantially uniform thickness, the generation of a tip vortex can be prevented on every section of the blade 200.

The height H of the first end 350 of the longitudinal member 300 is the maximum height of the whole longitudinal member 300, and the longitudinal member 300 has a tapered structure connected to the second end 360 (tapered from the first end 350 to the second end 360). Furthermore, in a region P from the first end 350 to a predetermined position of the longitudinal member 300, the windward surface 210 is parallel to the bottom surface 320 of the longitudinal member 300. Therefore, when the fan module operates at a high rotational speed (the rotational speed exceeds 1000 rpm, for example, 2200 rpm), the longitudinal member 300 can achieve the purpose of noise reduction, and can further reduce the power consumption of the fan module and enhance the air pressure and the air volume.

The region P from the first end 350 to the predetermined position of the longitudinal member 300 can be ½-¼ of the length of the longitudinal member 300 (⅓ for example). The height H of the first end 350 can be 2-10% of the distance between the central axis S and the end side 240 (4% for example). The thickness of the longitudinal member 300 along the radial direction can be 2-10% of the distance between the central axis S and the end side 240 (2% for example).

Figure 6:
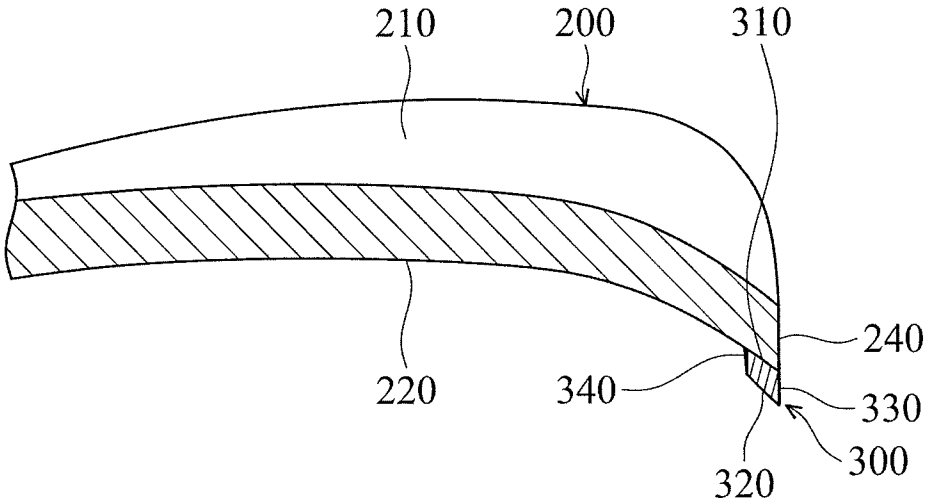
FIG. 6 is a s cross-sectional view along line B-B in FIG. 2.

FIG. 6 is a cross-sectional view along line B-B in FIG. 2. As shown in FIG. 6, in this embodiment, the bottom surface 320 of the longitudinal member 300 has an inclined surface or a curved surface, which is inclined relative to the outer surface 330.

Figure 7A:
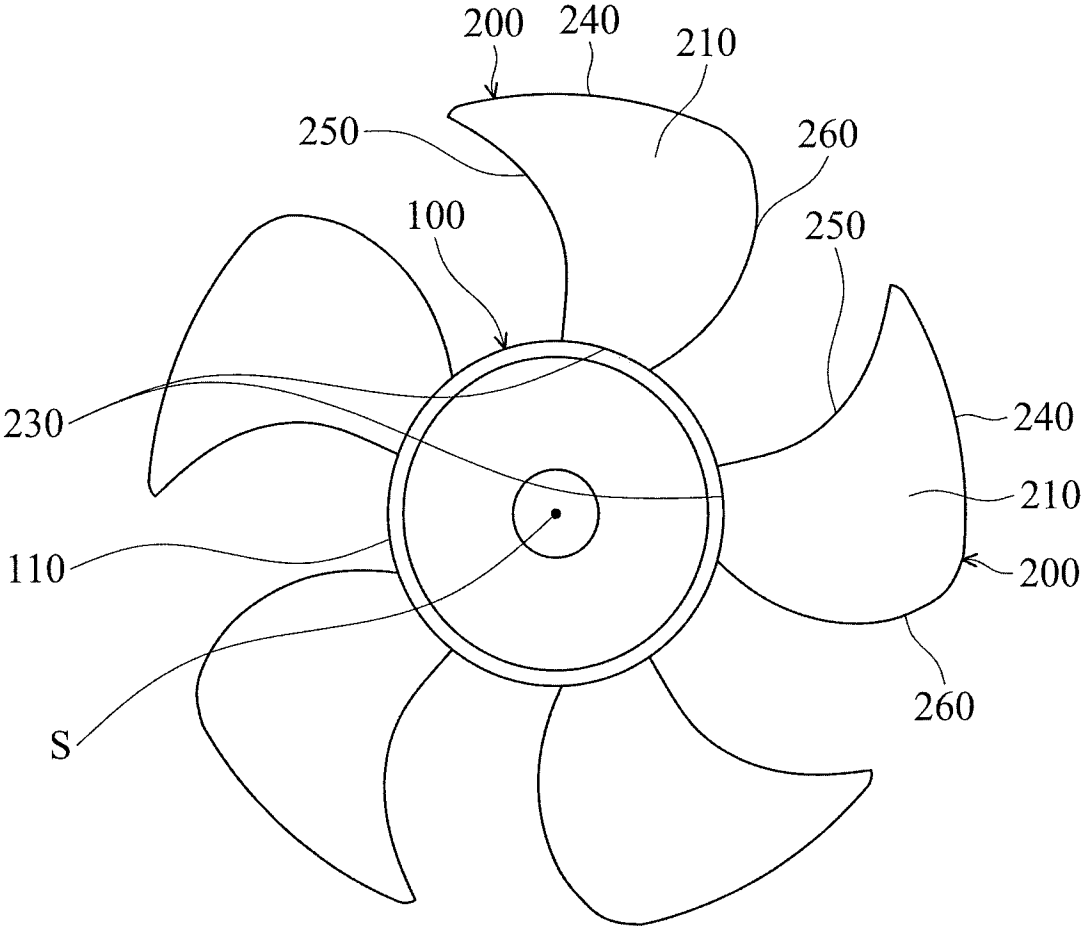
FIG. 7A is a schematic diagram of a fan module according to another embodiment of the invention.
Figure 7B:
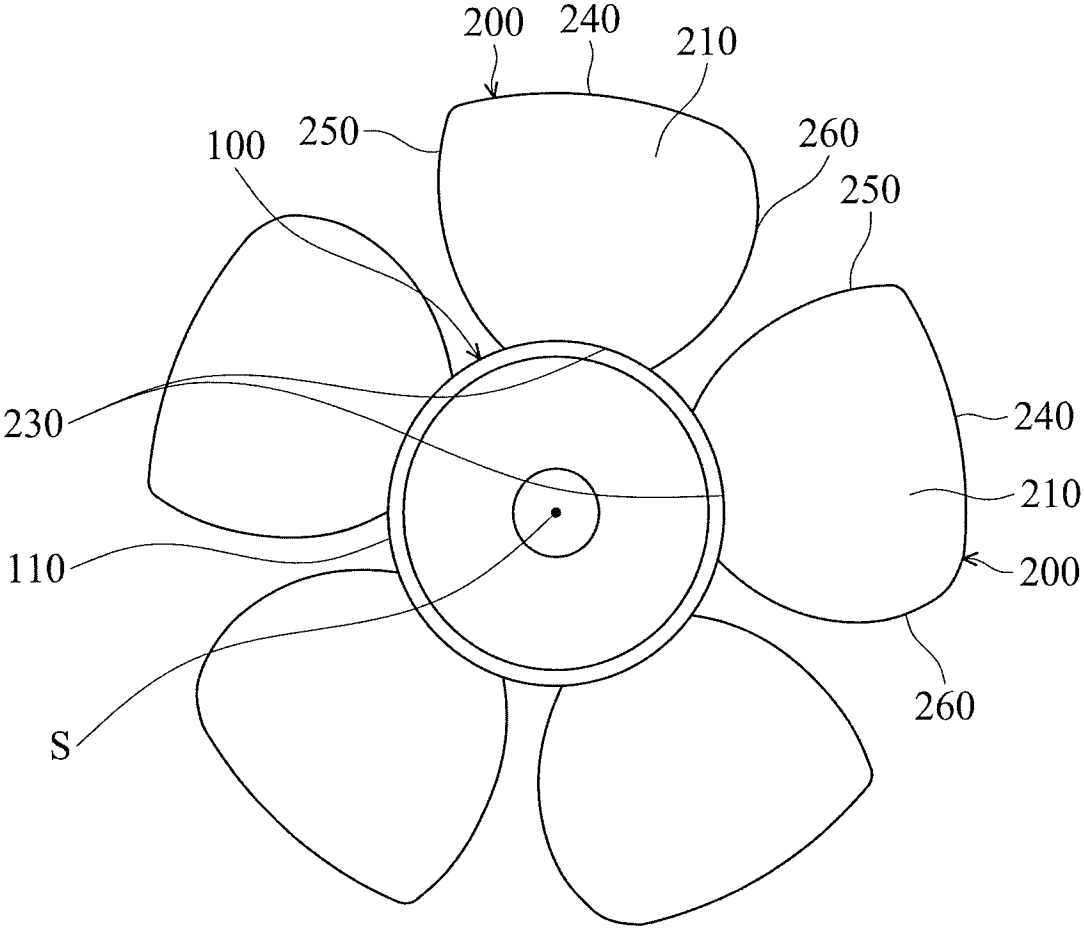
FIG. 7B is a schematic diagram of a fan module according to another embodiment of the invention.

As shown in FIGS. 2 and 4, in this embodiment, the windward side 250 of the blade 200 has a plane structure, and the leeward side 260 has a convex structure. When the fan module operates, the airflow generated by the windward side 250 having the plane structure and the leeward side 260 having the convex structure can correspond to the aforementioned longitudinal member 300 so as to reduce the noise and the power consumption, and enhance the air pressure and the air volume effectively. As shown in FIGS. 7A and 7B, in some embodiments, the windward side 250 can have a concave structure or a convex structure.

In this embodiment, the hub 100, the blade 200, and the longitudinal member 300 can be made of plastic. In some embodiments, the hub 100, the blade 200, and the longitudinal member 300 can be made of metal. In some embodiments, the hub 100, the blade 200, and the longitudinal member 300 can have plastic or metal, for example, the hub 100 is made of metal, and the blade 200 and the longitudinal member 300 are made of plastic.

Figure 8:
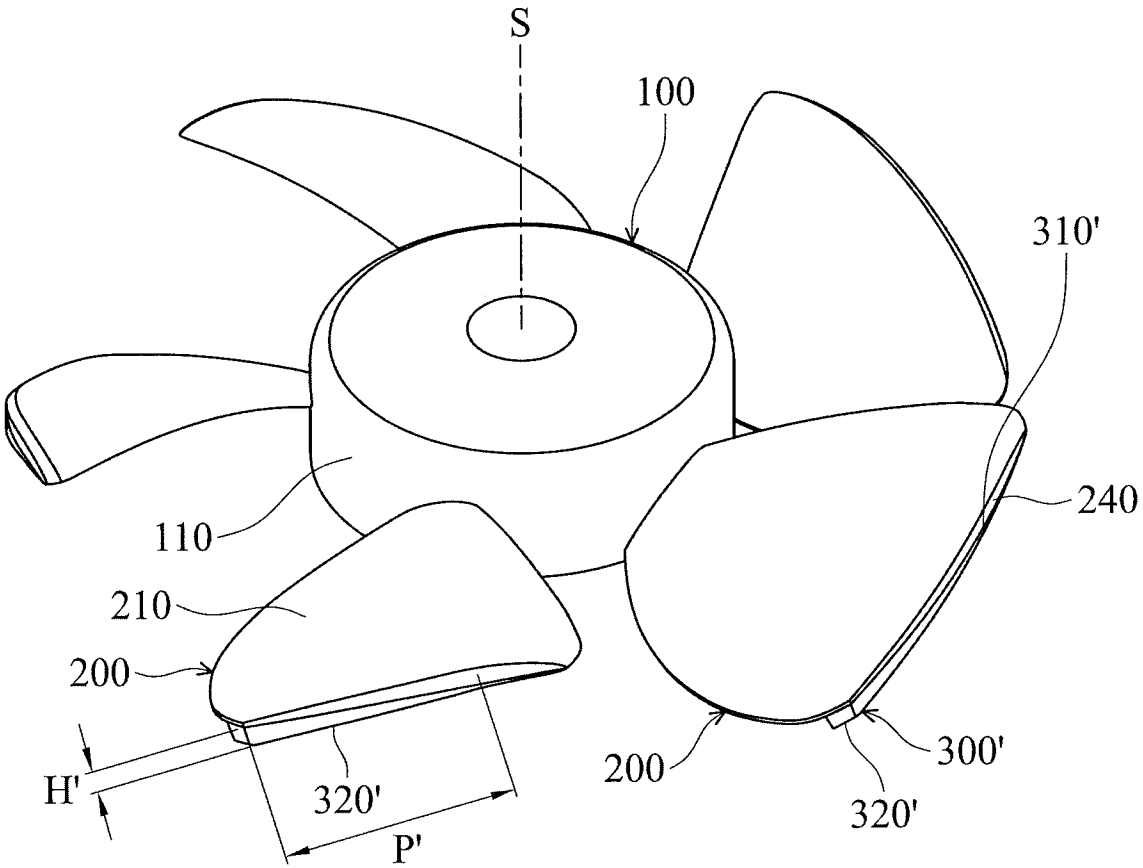
FIG. 8 is a schematic diagram of a fan module according to another embodiment of the invention.
Figure 9:
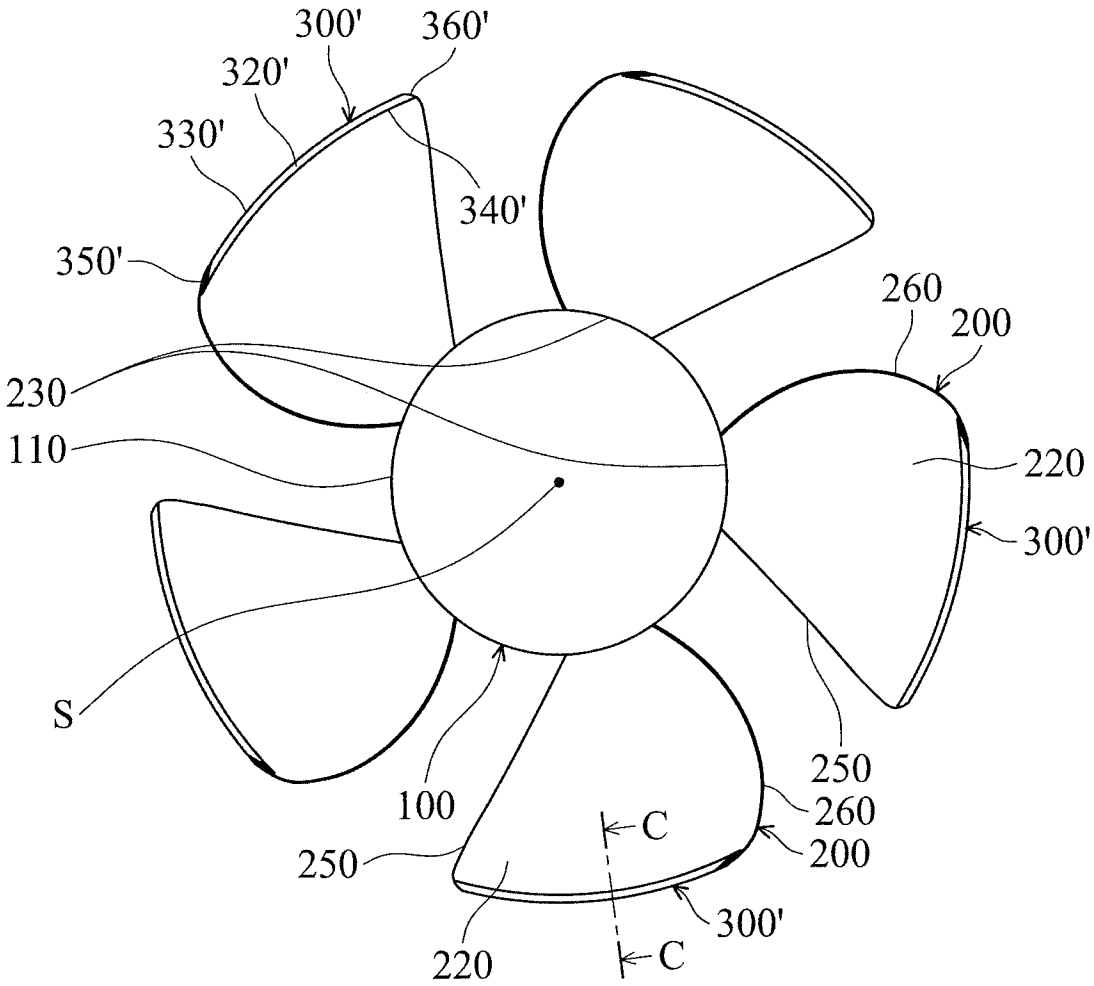
FIG. 9 is a bottom view of the fan module in FIG. 8.

Referring to FIGS. 8 and 9, in another embodiment, the fan module primarily comprises a hub 100, a plurality of blades 200, and a plurality of longitudinal members 300'. The structure and the position of the hub 100 and the blades 200 in FIG. 1 are the same as that of the hub 100 and the blades 200 in this embodiment so that the descriptions thereof will not be repeated here.

Similarly, each of the blades 200 has one longitudinal member 300' disposed thereon. The longitudinal member 300' is disposed on the leeward surface 220 of the blade 200 and connected to the end side 240 thereof. When the hub 100 drives the blade 200 to rotate around the central axis S, the air flowing to the end side 240 can be blocked by the longitudinal member 300'. Since less of the air leaves from the end side 240, the probability of a tip vortex being generated is reduced. Therefore, the loudness produced from the operation of the fan module can be reduced, and the purpose of noise reduction can be achieved.

The longitudinal member 300' has a top surface 310', a bottom surface 320,' an outer wall 330', an inner wall 340', a first end 350', and a second end 360'. The top surface 310' is attached on the leeward surface 220 of the blade 200, and the bottom surface 320' is opposite to the top surface 310'. The outer wall 330' and the inner wall 340' are connected to the top surface 310' and the bottom surface 320', and disposed on the opposite surfaces of the longitudinal member 300'. In this embodiment, the outer wall 330' of the longitudinal member 300' is aligned with the end side 240 of the blade 200, such that the blade 200 can achieve an integrated appearance. The distances between the central axis S and every section of the inner wall 340' are the same: in other words, the center of curvature of the inner wall 340' is disposed on the central axis S.

The first end 350' of the longitudinal member 300' is connected to the leeward side 260 of the blade 200, and the second end 360' opposite to the first end 350' is connected to the windward side 250 of the blade 200. Since the longitudinal member 300' in the embodiment is extended from the windward side 250 to the leeward side 260 and has a substantially uniform thickness, the generation of a tip vortex can be prevented on every section of the blade 200.

The height H' of the first end 350' of the longitudinal member 300' is the maximum height of the whole longitudinal member 300', and the longitudinal member 300' has a tapered structure connected to the second end 360' (tapered from the first end 350' to the second end 360'). Furthermore, in a region P' from the first end 350' to a predetermined position of the longitudinal member 300', the windward surface 210 is parallel to the bottom surface 320' of the longitudinal member 300'. Therefore, when the fan module operates at a high rotational speed (the rotational speed exceeds 1000 rpm, for example, 2200 rpm), the longitudinal member 300' can achieve the purpose of noise reduction, and can further reduce the power consumption of the fan module and enhance the air pressure and the air volume.

The region P' from the first end 350' to the predetermined position of the longitudinal member 300' can be ½-¼ of the length of the longitudinal member 300' (⅓ for example). The height H' of the first end 350' can be 2-10% of the distance between the central axis S and the end side 240 (4% for example). The thickness of the longitudinal member 300' along the radial direction can be 2-10% of the distance between the central axis S and the end side 240 (2% for example).

Figure 10:
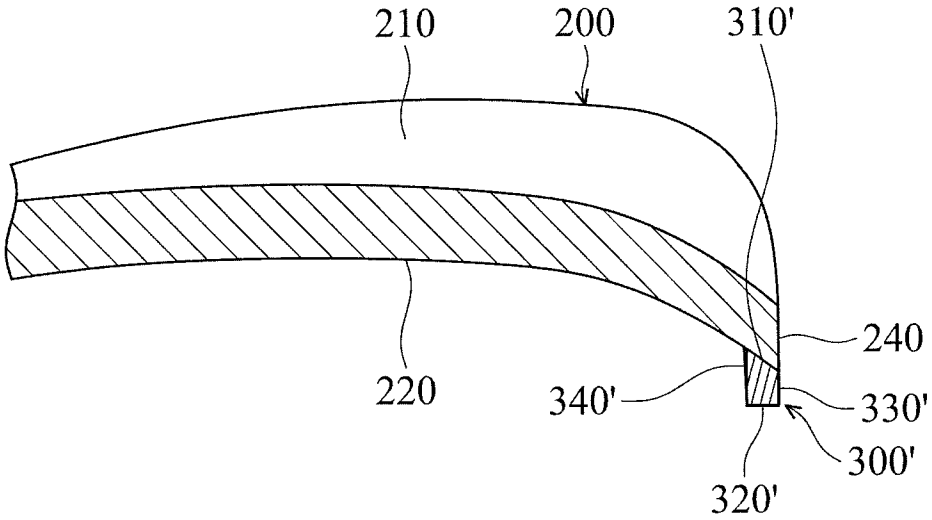
FIG. 10 is a s cross-sectional view along line C-C in FIG. 8.

FIG. 10 is a cross-sectional view along line C-C in FIG. 9. As shown in FIG. 10, in this embodiment, the bottom surface 320' is substantially perpendicular to the outer wall 330' of the blade 200. Thus, the inner wall 340' can more protrude from the leeward surface 220, the air can be blocked from leaving from the end side 240, and the probability that a tip vortex will be generated is reduced.

Similarly, in this embodiment, the appearances of the windward side 250 and the leeward side 260 of the blade 200 can be adjusted as required. For example, the windward side 250 can have a plane structure, a concave structure, or a convex structure, and the leeward side 260 can have a convex structure.

In summary, a fan module is provided. Since the longitudinal member is disposed on the leeward surface of the blade of the fan module, it can reduce the noise and the power consumption, and enhance the air pressure and the air volume even when the fan module operates at a high rotational speed.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A fan module, comprising:

a hub;

a plurality of blades, connected to the hub, wherein each of the blades comprises:

a base side, connected to the hub;

an end side, opposite to the base side;

a windward side, connected to the base side and the end side;

a leeward side, connected to the base side and the end side, wherein the windward side and the leeward side are disposed on the opposite sides of the blade;

a windward surface; and a leeward surface, opposite to the windward surface; and a plurality of longitudinal members, wherein each of the longitudinal members is disposed on the leeward surface of each of blades, connected to the end side, and has a first end, a second end, and a tapered structure, wherein the first end is adjacent to the leeward side and the second end is adjacent to the windward side, the height of the first end in a direction that is perpendicular to the leeward surface is the maximum height of the longitudinal member, and the tapered structure is connected to the second end.

2. The fan module as claimed in claim 1, wherein each of the longitudinal members is extended from the windward side to the leeward side.

3. The fan module as claimed in claim 1, wherein each of the longitudinal members has an outer wall aligned with the end side.

4. The fan module as claimed in claim 1, wherein each of the longitudinal members has a bottom surface, and the windward surface is parallel to the bottom surface between the first end and a predetermined position of the longitudinal member.

5. The fan module as claimed in claim 4, wherein the distance between the first end and the predetermined position of the longitudinal member is ½-¼ of the length of the longitudinal member.

6. The fan module as claimed in claim 1, wherein the longitudinal members have a substantially uniform thickness in a radial direction of the fan module.

7. The fan module as claimed in claim 1, wherein the hub has a central axis, and each of the longitudinal members has an inner wall, wherein the center of curvature of the inner wall is disposed on the central axis.

8. The fan module as claimed in claim 1, wherein each of the longitudinal members has a bottom surface and an outer wall, and the bottom surface is inclined relative to the outer wall.

9. The fan module as claimed in claim 1, wherein each of the longitudinal members has a bottom surface and an outer wall, and the bottom surface is perpendicular to the outer wall.

10. The fan module as claimed in claim 1, wherein the windward side has a plane structure, a concave structure, or a convex structure.

11. A fan module, comprising:

a hub;

a plurality of blades, connected to the hub, wherein each of the blades comprises:

a base side, connected to the hub;

an end side, opposite to the base side;

a windward side, connected to the base side and the end side;

a leeward side, connected to the base side and the end side, wherein the windward side and the leeward side are disposed on the opposite sides of the blade;

a windward surface; and a leeward surface, opposite to the windward surface; and a plurality of longitudinal members, wherein each of the longitudinal members is disposed on the leeward surface of each of blades, connected to the end side, and has a first end and a second end, wherein the first end is adjacent to the leeward side and the second end is adjacent to the windward side, and the height of the first end in a direction that is perpendicular to the leeward surface is the maximum height of the longitudinal member.

12. The fan module as claimed in claim 11, wherein each of the longitudinal members is extended from the windward side to the leeward side.

13. The fan module as claimed in claim 11, wherein each of the longitudinal members has an outer wall aligned with the end side.

14. The fan module as claimed in claim 11, wherein each of the longitudinal members has a bottom surface, and the windward surface is parallel to the bottom surface between the first end and a predetermined position of the longitudinal member.

15. The fan module as claimed in claim 11, wherein the distance between the first end and the predetermined position of the longitudinal member is ½-¼ of the length of the longitudinal member.

16. The fan module as claimed in claim 11, wherein the longitudinal members have a substantially uniform thickness in the radial direction of the fan module.

17. The fan module as claimed in claim 11, wherein the hub has a central axis, and each of the longitudinal members has an inner wall, wherein the center of curvature of the inner wall is disposed on the central axis.

18. The fan module as claimed in claim 11, wherein each of the longitudinal members has a bottom surface and an outer wall, and the bottom surface is inclined relative to the outer wall.

19. The fan module as claimed in claim 11, wherein each of the longitudinal members has a bottom surface and an outer wall, and the bottom surface is perpendicular to the outer wall.

20. The fan module as claimed in claim 11, wherein the windward side has a plane structure, a concave structure, or a convex structure.

* * * * *